US006791033B2

(12) United States Patent
Lakner et al.

(10) Patent No.: US 6,791,033 B2
(45) Date of Patent: Sep. 14, 2004

(54) HIGH-VOLTAGE INSULATION SYSTEM

(75) Inventors: Martin Lakner, Birmenstorf (CH); Friedrich Koenig, Oberbozberg (CH)

(73) Assignee: ABB Research Ltd., Zurich (CH)

( * ) Notice: Subject to any disclaimer, the term of this patent is extended or adjusted under 35 U.S.C. 154(b) by 177 days.

(21) Appl. No.: 09/841,082

(22) Filed: Apr. 25, 2001

(65) Prior Publication Data

US 2001/0047879 A1 Dec. 6, 2001

(30) Foreign Application Priority Data

Apr. 25, 2000 (DE) ..... 100 20 228

(51) Int. Cl.[7] ..... H01F 36/00

(52) U.S. Cl. ..... 174/137 B; 174/17 LF; 336/DIG. 1; 336/15; 336/90

(58) Field of Search ..... 174/17 LF, 17 GF, 174/18, 137 B, DIG. 10; 336/DIG. 1, 15, 90

(56) References Cited

U.S. PATENT DOCUMENTS

| | | | | | |
|---|---|---|---|---|---|
| 3,710,293 | A | * | 1/1973 | Lazor | 336/198 |
| 3,775,719 | A | * | 11/1973 | Gainer et al. | 336/58 |
| 3,931,027 | A | * | 1/1976 | Sadler et al. | 336/94 |
| 4,146,858 | A | * | 3/1979 | McDermott | 336/90 |
| 4,447,796 | A | * | 5/1984 | Heinrichs | 336/60 |
| 4,623,953 | A | * | 11/1986 | Dakin | 336/94 |
| 5,736,915 | A | * | 4/1998 | Goedde et al. | 336/55 |
| 6,069,430 | A | * | 5/2000 | Tsunoda et al. | 174/120 SR |
| 6,351,202 | B1 | * | 2/2002 | Ito et al. | 336/15 |
| 6,514,610 | B2 | * | 2/2003 | Itoyama et al. | 428/372 |

FOREIGN PATENT DOCUMENTS

| | | |
|---|---|---|
| DE | 1640249 | 8/1970 |
| DE | 2 327 629 | 12/1974 |
| DE | 2443398 | 3/1975 |
| DE | 2731251 | 1/1978 |
| DE | 4403288 A1 | 3/1995 |
| DE | 4340046 A1 | 6/1995 |
| EP | 0757363 A2 | 2/1997 |
| EP | 0 971 368 | 1/2000 |

OTHER PUBLICATIONS

Kenneth G. Herd et al., "Development and Fabrication of a Bi–2223 Racetrack Coil for Generator Applications", IEEE Transactions on Applied Superconductivity, vol. 7, No. 2, Jun. 1997, pp. 531–534.

L. Hahn, et al. "Werkstoffkunde für die Elektrotechnik und Elektronik", VeB Verlag Technik, Berlin, 1983, pp. 423–424, 10. 10. Papier und Preβspan.

* cited by examiner

*Primary Examiner*—Anthony Dinkins
*Assistant Examiner*—Adolfo Nino
(74) *Attorney, Agent, or Firm*—Burns, Doane, Swecker & Mathis, L.L.P.

(57) ABSTRACT

The present invention relates to a high-voltage insulation system which is suitable for low temperatures and which, in addition to a cooling liquid (3) comprises a solid material insulator (2) based on a cellulose fabric (20). The solid material insulator (2) is preferably used in the form of pressboards and is impregnated with a polymer resin (21). It has a high partial discharge inception field of 77 K and, in addition, its thermal coefficient of expansion is optimally matched to that of ceramic high-temperature superconductors. The pressboards can be formed in the dry stage, in particular to produce coil formers, and are joined together alternately with cotton fabrics to form laminates of any desired thickness.

14 Claims, 1 Drawing Sheet

HIGH-VOLTAGE INSULATION SYSTEM

This application claims priority under 35 U.S.C. §§119 and/or 365 to Appln. Ser. No. 100 20 228.4 filed in Germany on Apr. 25, 2000; the entire content of which is hereby incorporated by reference.

FIELD OF THE INVENTION

The present invention relates to the field of high-voltage insulation. It relates in particular to a high-voltage insulation system for electrical insulation of components whose operating temperature is below room temperature, and a method for producing such a system.

BACKGROUND

For use in the field of electrical power supply with system voltages of up to 550 kV, a high-voltage insulation system which is suitable for low temperatures is required for electrical parts or components which are intended to be used primarily at an operating temperature below room temperature. A combination of a coolant and solid material insulation is often used for this purpose. If the envisaged operating temperatures are sufficiently low, chemical aging processes as degradation mechanisms for the solid material insulation can virtually be ruled out. On the other hand, thermal stresses are caused in the insulation material as a result of the difference between the manufacturing temperature and the operating temperature, which may lead to damage such as cracks or de-lamination when cooled down and heated up frequently. If the electrical parts or components are in direct mechanical contact with the solid material insulation, the thermal co-efficient of expansion of the insulation must, furthermore, not differ excessively from that of the component, in order to avoid stresses in the latter.

Electrical parts having components based on high-temperature superconductors, for example, cables, transformers, current limiters and the like, are of particular interest. Liquid nitrogen ($LN_2$) is preferably used for cooling high-temperature superconductors to operating temperatures below 80 K.

The solid material insulation which is used is also generally intended to have a certain mechanical robustness and to be capable of acting as a support or stabilizer for, for example, components composed of ceramic high-temperature superconductor material. Insulation composed of polymer films or sulfate paper is not suitable for use in these circumstances. Insulation components which can be stressed mechanically are normally produced from glass-fiber-reinforced fiber composite materials. The latter contain a polymer matrix composed of cured epoxy resin and glass fibers or carbon fibers as the reinforcing base material. Fiber composite materials containing glass fibers have a low partial discharge inception field of >>1 kV/mm at 77 K, however, and even if special vacuum-pressure impregnation methods are used for casting the resin compound, the best that can be achieved is >>4 kV/mm. Accordingly, in order to avoid excessive field strengths, the insulation must not be less than a certain minimum thickness, which is not consistent with efforts to achieve compact dimensions.

Pressboards, i.e. compressed boards produced from cellulose are frequently used for insulation of transformers and are in widespread use, for example, under the name "Transformerboard". These are available in thicknesses from 0.5 mm to a few mm and, in laminated and bonded form, up to more than 100 mm. U.S. Pat. No. 3,710,293 discloses an insulation system comprising layers of pressboards and sulfate or kraft paper, which are cast using a thermoplastic resin. As an alternative to this, solid material insulation impregnated with oil and composed of cellulose paper is used to form barriers between adjacent winding layers in oil-cooled transformers. First, however, the former has to be dried by means of a complex heat-treatment and vacuum method. This is intended to prevent the cellulose material from releasing water to the oil and thus reducing its dielectric characteristics.

SUMMARY

An exemplary embodiment of the present invention provides a high-voltage insulation system for use at temperatures below room temperature and with a high partial discharge inception field, and specifies a method for producing such a system.

The essence of the invention is to use as an electrically insulating coolant in conjunction with solid material insulation in the form of a composite material, which comprises cellulose fibers impregnated with polymer resin. The increased partial discharge inception field of the polymer composite allows the high-voltage insulation system to have more compact dimensions and thus also results in cost savings.

According to a first preferred embodiment, liquid nitrogen $LN_2$ is used as a coolant. $LN_2$ is suitable for cooling high-temperature superconductors to an operating temperature of 77 K or less. In the range between room temperature and the operating temperature, the mean thermal coefficient of expansion of the cellulose polymer matrix composite is comparable to that of the high-temperature superconductor. This results in the possibility of bringing the cellulose composite and the high-temperature superconductor into direct and permanent mechanical contact without any need to be concerned about damage induced by stresses during cooling or heating.

In order to allow the solid material insulator to provide mechanical support for the high-temperature superconductor ceramic, the cellulose material is advantageously used in the form of pressboards. In order to achieve greater thicknesses and further improve mechanical robustness, a number of thin boards, which can be formed individually, can be laminated. An intermediate layer composed of a suitable fabric absorbs excess polymer resin and prevents the formation of a pure resin layer between the pressboards.

An exemplary method according to the invention for producing a high-voltage insulation system which is suitable for low temperatures, is distinguished by the pressboards being formed in the dry state and then being impregnated, that is to say, soaked with a polymer resin. Since the process of forming the pressboards does not involve moistening them, there is also no need for the tedious drying process required for the subsequent impregnation. In consequence, there is no risk either of the formed pressboard becoming inadvertently distorted during the drying process.

According to further embodiment, a cylindrical coil former or coil support is formed from the pressboards, and a superconducting wire is then wound on it. The coil former and winding are then jointly encapsulated with polymer resin, which results in the windings being bonded and mechanically fixed to the coil former.

BRIEF DESCRIPTION OF THE DRAWINGS

The invention will be explained in more detail in the following text with reference to exemplary embodiments and in conjunction with the drawings, in which.

DETAILED DESCRIPTION

Figure 1A:
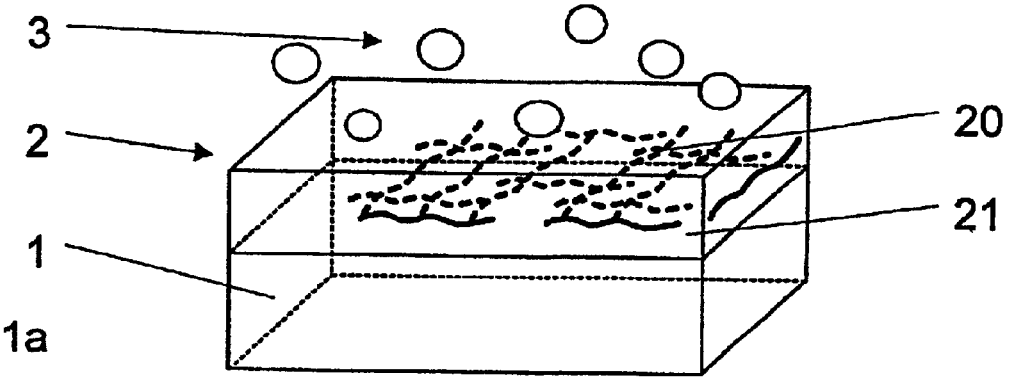
FIG. 1A shows a detail of a high-voltage insulation system according to the invention.

The reference symbols used in the drawings are summarized in the list of reference symbols. In principle, identical parts are provided with the same reference symbols.

FIG. 1A shows a high-voltage insulation system according to the invention together with a conductor 1 which is at a high electrical potential. Conductor 1 is part of an electrical component which, in order to operate in its intended manner, must be cooled to an operating temperature which is below ambient or room temperature (20–25° C.). The high-voltage insulation system comprises a solid material insulator 2 and a fluid, that is to say liquid or gaseous coolant 3. The solid material insulator 2 comprises a base fabric 20 and a polymer matrix 21. The matrix systems are preferably three-dimensionally crosslinked thermosetting plastics and are based, for example, on curved epoxy, silicon or polyester resins. According to the invention, the base fabric 20 is composed of cellulose fibers (processed cellulose).

Figure 1B:
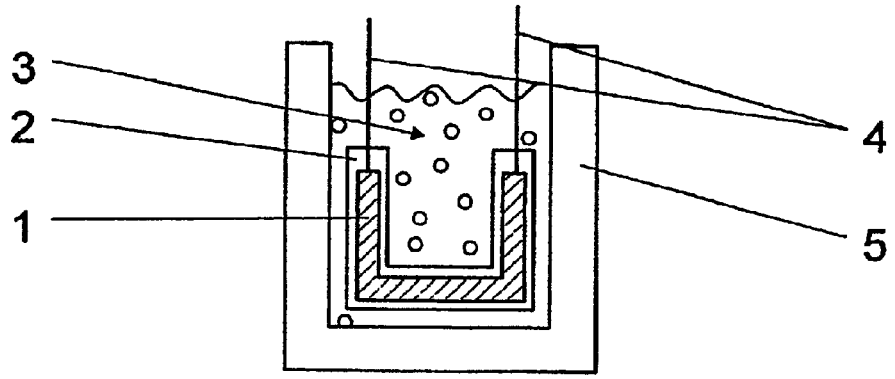
FIG. 1B shows a section through an arrangement having a conductor which is electrically insulated according to the invention.

FIG. 1B shows an arrangement having a conductor 1 as a part of an electrical component which is to be cooled and is connected via supply lines 4 to a power supply system, which is not illustrated. The conductor 1 is surrounded by solid material insulation 2 according to the invention, and is immersed in a cooling liquid 3. The cooling liquid 3 is contained in a thermally insulating cooling container 5.

In the prior art, glass fibers are used because of the mechanical characteristics which can be achieved, and they are impregnated with a polymer resin. The reason for the disappointing partial discharge inception field of less than 4 kV/mm mentioned initially for impregnated glass fibers is the fact that the glass fibers need to be coated, and this prevents the fibers from being completely wetted with resin. This results in microscopically small cavities on the fibers in which partial discharge take place, and this in turn leads to accelerated aging of the glass fiber insulation. In contrast, partial discharge inception fields of up to 10 kV/mm can be achieved at a temperature of 77 K using cellulose impregnated with polymer resin, since the cellulose fibers can be impregnated better and no cavities are formed.

The conductor 1 is, for example, a high-temperature superconductor and, as such, is part of a component used for electrical power transmission (transmission cable, transformer or current limiter). The planar conductor geometry shown in FIG. 1 is in no way exclusive, and the conductor 1 may also be suitably curved or be in the form of a wire, possibly in conjunction with a normally conductive matrix. Furthermore, the use of substrates or normally conductive bypass layers is feasible. The critical temperature of known high-temperature superconductor materials is more than 80 K, so that the use of liquid nitrogen $LN_2$ as the coolant, whose boiling point under normal pressure is 77 K, allows high-temperature superconductors such as this to be used.

The thermal coefficient of expansion of a ceramic superconductor is typically about $10\times10^{-6}$/K, and the coefficient of expansion along the plane of a cellulose fabric impregnated with polymer resin is in the range $6–13\times10^{-6}$/K. There is thus so little difference between the thermal coefficients of expansion that the cellulose composite and the high-temperature superconductor contract to the same extent during cooling to the operating temperature. Thus, if they have both been bonded in advance at ambient temperature, for example by means of the said polymer resin to form a mechanical composite, no thermal-mechanical stresses occur.

Cellulose is available, inter alia, pressed in the form of pressboards, with a density of >>1.2 g/cm$^3$. Boards such as these can also be impregnated with low-viscosity polymer resins using appropriate processes. For this purpose, the boards must be thoroughly dried in advance. Such encapsulated boards may provide a supporting function and, thanks to the similar thermal coefficients of expansion, can stabilize superconductors adjacent to them.

Individual thin boards can be formed to a certain extent, with this process normally being carried out in the moist state. A problem in this case is that the geometry of the formed plate changes once again during the subsequent drying process, that is to say a certain amount of shape instability occurs. If dry forming is used, the minimum radius of curvature cannot be reduced indefinitely, and the minimum radius of curvature which can be achieved for a board thickness of 1 mm is 15 cm. Formed or planar individual boards can be joined together, and then impregnated, to form laminates.

For this purpose, it is advantageous to provide an intermediate layer between the individual boards, since, other wise, excess resin can accumulate as a thin, pure resin layer with a thickness of <50 mm between the boards. On cooling, this leads to a tendency to de-lamination of the laminate. A fabric composed of cotton, nylon fibers of polyethylene fibers is suitable, for example, as the material for the intermediate layer.

Figure 2:
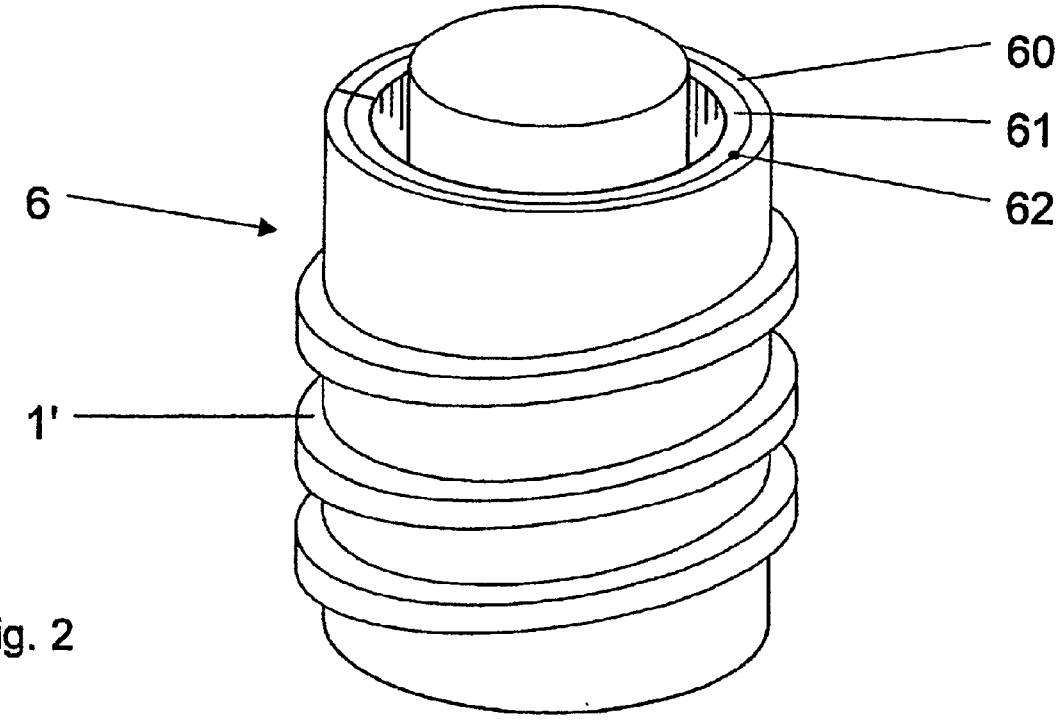
FIG. 2 shows a coil having a coil former as part of a high-voltage insulation system according to one preferred embodiment of the invention.

FIG. 2 shows, schematically, a superconducting coil having a hollow-cylindrical coil former 6, composed of a composite having two layers 60, 61 which have been formed individually to create tubes and are separated by an intermediate layer 62. A superconducting wire 1' is wound on the coil former 6. The interior of the coil former 6 and the external area surrounding the coil are filled with a coolant, which is not illustrated. During production of the coil, it is advantageous not to carry out the impregnating process, that is to say the encapsulation of the coil, until the wire 1' has been wound onto it, since this also results in the wire 1' being fixed on the coil former 6.

Since one unavoidable problem in high-voltage components is the major increase in the electrical field at edges, apertures and the like, it is advantageous to provide the insulation system and, in particular, the solid material insulator, with certain field-controlling or field-grading characteristics. To this end, a material having a high dielectric constant, for example, carbon black, is added in powder form to the polymer resin, or is provided in fabric form as part of the intermediate layer. This gives the composite semiconductive characteristics. An aluminum foil can likewise be used as part of the intermediate layer for geometric field grading.

If additional mechanical reinforcement is desired, further glass fibers can be used, once again either in the polymer matrix or as a glass fiber mat in the intermediate layer. This is done, of course, only where there are no high electrical fields and there is no need to be concerned about partial discharges.

List of Reference Symbols

1,1' Conductor, winding
2 Solid material insulator
20 Base fabric
21 Matrix
3 Coolant
4 Supply lines
5 Coolant container
6 Coil former
60, 61 Rolled pressboards
62 Intermediate layer

What is claimed is:

1. A high-voltage insulation system for electrical insulation of components whose operating temperature is below ambient temperature comprising a coolant and a solid material having a cured polymer matrix and a base fabric, wherein the base fabric comprises cellulose in the form of pressboards.

2. The high-voltage insulation system as claimed in claim 1, wherein the coolant comprises liquid nitrogen and the components contain high-temperature superconductor material.

3. The high-voltage insulation system as claimed in claim 1, wherein the base fabric comprises a laminate having at least two layers of pressboards, which are separated by at least one intermediate layer.

4. The high-voltage insulation system as claimed in claim 3, wherein the intermediate layer comprises a fabric composed of cotton, nylon or polyethylene fibers.

5. The high-voltage insulation system as claimed in claim 1, wherein, in order to grade electrical fields, carbon in the form of fibers or fabrics is added to the base fabric.

6. The high-voltage insulation system as claimed in claim 1, wherein, for mechanical reinforcement glass fibers in the form of fibers or fabrics are added to the base fabric.

7. The high-voltage insulation system of claim 1, wherein the solid material has a low partial discharge inception field between 1 kV/mm and 10 kV/MM at a temperature of 77 K.

8. An electrical device immersed in a coolant and having components whose operating temperature is below ambient temperature and having a high-voltage insulation system for electrical insulation of the components, the insulation system comprising a solid material with a cured polymer matrix and a base fabric comprising cellulose in the form of pressboards.

9. The electrical device as claimed in claim 8, wherein in order to grade electrical fields, carbon in the form of fibers or fabrics is added to the intermediate layer.

10. The electrical device as claimed in claim 8, wherein the coolant comprises liquid nitrogen and the components contain high-temperature superconductor material.

11. The electrical device as claimed in claim 8, wherein the base fabric comprises a laminate having at least two layers of pressboards, which are separated by at least one intermediate layer.

12. The electrical device of claim 11, wherein the intermediate layer comprises a fabric composed of cotton, nylon or polyethylene fibers.

13. The electrical device of claim 8, wherein for mechanical reinforcement, glass fibers in the form of fibers or fabrics are added to the base fabric.

14. The electrical device of claim 8, wherein the solid material has a low partial discharge inception field between 1 kV/mm and 10 kV/mm at a temperature of 77K.

* * * * *